US010081467B2

(12) United States Patent
Daws, II et al.

(10) Patent No.: US 10,081,467 B2
(45) **Date of Patent: *Sep. 25, 2018**

(54) CONTAINER WITH IMPROVED LOCKING SYSTEM

(71) Applicant: Daws Manufacturing Company, Inc., Pensacola, FL (US)

(72) Inventors: Harold C. Daws, II, Gulf Breeze, FL (US); Aaron Floyd, Cantonment, FL (US); Craig Harrison, Gulf Breeze, FL (US)

(73) Assignee: Daws Manufacturing Company, Inc., Pensacola, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/585,349

(22) Filed: May 3, 2017

(65) Prior Publication Data

US 2017/0233155 A1 Aug. 17, 2017

Related U.S. Application Data

(63) Continuation-in-part of application No. 14/970,759, filed on Dec. 16, 2015, now Pat. No. 9,663,278.

(51) Int. Cl.

| | |
|---|---|
| ***B65D 55/14*** | (2006.01) |
| ***E05B 67/38*** | (2006.01) |
| ***B65D 43/16*** | (2006.01) |
| ***B65D 25/24*** | (2006.01) |
| ***E05B 63/24*** | (2006.01) |
| ***E05B 65/52*** | (2006.01) |

(52) U.S. Cl.

CPC ..... *B65D 55/14* (2013.01); *B65D 25/24* (2013.01); *B65D 43/16* (2013.01); *E05B 63/244* (2013.01); *E05B 65/5276* (2013.01); *E05B 67/383* (2013.01)

(58) Field of Classification Search

CPC ..... B65D 55/14; B65D 55/10; B65D 55/02; E05B 65/5246; E05B 65/5207; E05B 65/52; E05B 67/06; E05B 67/00; E05B 67/383; E05B 17/2003; E05C 1/04; E05C 19/182

USPC ..... 220/324, 315, 810; 248/552, 213.2, 248/205.1; 292/104, 205, 148, 346; 70/54–56, 158–162

See application file for complete search history.

(56) References Cited

U.S. PATENT DOCUMENTS 1,635,711 A * 7/1927 Fraim ..... E05B 67/22 224/42.25
9,663,278 B1 * 5/2017 Daws, II ..... E05B 63/244

* cited by examiner

*Primary Examiner* — Robert J Hicks
(74) *Attorney, Agent, or Firm* — GrayRobinson, P.A.; Thomas L. Kautz

(57) ABSTRACT

A locking system for a storage container comprises a housing mounted by a bracket within a cavity formed in at least one end wall of the container. The housing receives a padlock having a shackle movable between a locked position and an unlocked position relative to the latch arms of a latch mounted to the lid of the container, and a guard is connected to the front wall of the container and to the bracket in position to block access to at least that portion of the shackle which captures the latch arms of the latch.

11 Claims, 13 Drawing Sheets

CONTAINER WITH IMPROVED LOCKING SYSTEM

FIELD OF THE INVENTION

This invention relates to storage containers, and, more particularly, to a storage container with an improved locking system.

BACKGROUND OF THE INVENTION

Containers such as tool boxes and storage cabinets are commonly used at construction sites and similar locations for the storage of tools and materials. Typical designs comprise a front wall, a back wall, a bottom wall and opposed end walls which are interconnected to form a hollow interior. The container interior is closed by a top wall or lid pivotal between open and closed positions on a hinge mounted to the back wall, usually with the assistance of gas springs.

Due to the value of tools and materials that may be held in storage containers, one or more locking mechanisms are generally employed to prevent theft. In horizontally oriented containers, it is typical to position a padlock at one or both of the corners of the lid to prevent it from being opened except when the padlock(s) are unlocked. Preferably, structure is provided to shield the padlock(s) from exposure to tampering, such as attempts to cut the shackle or pry open the body of the padlock.

One design of a locking mechanism for storage containers of the type described above is found in U.S. Pat. Nos. 6,772,613 and 8,096,152. Although somewhat different, the locking mechanism disclosed in each of these patents operates by causing a padlock to either block or permit lateral motion of a latch rod located in the interior of the container body relative to flanges mounted to the lid of the container. When lateral movement of the latch rod is blocked by alignment of the body of the padlock with one end of such rod, the latch rod engages the flanges carried by the lid thus preventing the lid from opening. After unlocking the padlock, the latch rod is free to move in a lateral direction without contacting the padlock body such that it disengages the lid flanges allowing the lid to be opened. Locking mechanisms of this type are relatively complex and depend on accurate alignment between a number of elements mounted to the lid and to the body of the container. Over the course of time and as a result of the often demanding conditions at job sites, the lids and bodies of storage containers may become misaligned making operation of latch rod difficult and/or preventing an end of the latch rod to engage the padlock body in order to lock the container.

These issues have been addressed in the locking system disclosed in U.S. patent application Ser. No. 14/970,759 which is described below and illustrated in FIGS. 1-8. The locking system of the '759 patent application comprises one or more locking assemblies each including a housing which is mounted by a bracket within a cavity formed in each end wall of the container. The housing has an interior which receives a padlock such that the shackle of the padlock extends through openings formed in the housing and bracket, in a direction toward the interior of the container, and the body of the padlock faces outwardly within the cavity. The shackle is movable between an unlocked position wherein the padlock body may be moved into a pocket formed in the housing interior, and a locked position in which the padlock body is located outside of such pocket.

The locking system further comprises a latch, and preferably a spring-biased hawk bill latch, which is mounted to the lid of the container in alignment with the shackle of the padlock. With the shackle in the locked position and the padlock body located outside of the pocket in the housing, the latch arms of the latch engage the shackle in the course of movement of the lid to the closed position. The latch arms open in response to initial contact with the shackle and then close around it when the lid is fully seated on the container body. An opening is provided between the latch arms in the closed position within which the shackle is captured. In order to open the lid, the padlock is unlocked allowing one end of the shackle to disengage the padlock body. The padlock body may then be moved into the pocket of the housing, in a direction toward the interior of the container body, causing the shackle to move in the same direction. In the course of such movement, that portion of the shackle which had been located between the latch arms moves through the opening between them until it clears such arms. With the latch arms no longer encircling the shackle, the lid may be opened.

Although the above-described locking system effectively locks the lid of the container in a locked position, it has been found that determined attempts to defeat such system may be successful. With reference to FIGS. 1-8, it is possible using a screw driver or other elongated tool, and a hammer, to break apart the housing 42 or drive it inwardly into the interior of the container 10 allowing access to the latch arms of 114, 116 of the latch 40. The screw driver may be inserted into the housing 42 from the area where a key is inserted into the padlock 46, and then using a hammer the screw driver can break the housing 42 apart, since it is a cast part and relatively brittle, and/or the housing 42 can be driven inwardly toward the container interior 22. Once the housing 42 is at least partially broken or driven inwardly, the screwdriver may be used to separate the latch arms 114, 116 from a position encircling the shackle 50 of the padlock 46 thus permitting opening of the lid 24.

As best seen in FIG. 6, with the lid 24 of the container 10 closed and the latch 40 in a locked position, the latch arms 114, 116 are exposed within the interior of the bracket 44. It has been found that if the front edge of the lid 24 in the area of the locking assembly 36 is pried upwardly, a screw driver or other elongated tool may be inserted into the interior 22 of the container 10 underneath the lid 24 and manipulated to disengage the latch arms 114, 116 from the shackle 50 of the padlock 46.

It is apparent that no locking system for containers of the type depicted in FIGS. 1-8 can completely prevent access to the container interior. The lid of the container could be breached using a power saw or cutting torch, for example. And while the potential ways of defeating the locking system disclosed the '759 application and described above require a good deal of effort, it would be beneficial to provide a means for preventing access to the container interior in the manner described above.

SUMMARY OF THE INVENTION

This invention is directed to a storage container with a locking system which is reliable and has a limited number of moving parts.

In the presently preferred embodiment, the locking system of this invention comprises a housing which is mounted by a bracket within a cavity formed in each end wall of the container. The housing has an interior which receives a padlock such that the shackle of the padlock extends through openings formed in the housing and bracket, in a direction toward the interior of the container, and the body of the padlock faces outwardly within the cavity. The shackle is movable between an unlocked position wherein the padlock body may be moved into a pocket fanned in the housing interior, and a locked position in which the padlock body is located outside of such pocket.

The locking system further comprises a latch, and preferably a spring-biased hawk bill latch, which is mounted to the lid of the container in alignment with the shackle of the padlock. With the shackle in the locked position and the padlock body located outside of the pocket in the housing, the latch arms of the latch engage the shackle in the course of movement of the lid to the closed position. The latch arms open in response to initial contact with the shackle and then close around it when the lid is fully seated on the container body. An opening is provided between the latch arms in the closed position within which the shackle is captured. In order to open the lid, the padlock is unlocked allowing one end of the shackle to disengage the padlock body. The padlock body may then be moved into the pocket of the housing, in a direction toward the interior of the container body, causing the shackle to move in the same direction. In the course of such movement, that portion of the shackle that had been located between the latch arms moves through the opening between them until it clears such aims. With the latch aims no longer encircling the shackle, the lid may be opened.

Additional structure may be incorporated into the locking system of this invention to overcome the manner in which one might defeat the system taught in the '759 application, as discussed above. In the presently preferred embodiment, a guard having an angled upper plate is connected to the front wall of the container and to the bracket in position to block access to at least that portion of the shackle which captures the latch arms of the latch. In the event one pries open the front edge of the lid of the container, neither a screwdriver nor any other tool may be employed to engage the latch arms of the latch when locked about the shackle of the padlock.

Further, the locking system of this invention includes structure for resisting displacement or shattering of the bracket from its point of connection to the container. Specifically, a pair of spaced mounting arms are connected to the same wall of the container where the bracket is mounted, and straddle the bracket. The mounting arms are formed with bores which align with bores formed in both the bracket and housing. A fastener such as a bolt may be inserted through the aligning bores to secure the bracket and housing to one another, and to secure both of them to the mounting arms. This construction provides a more robust connection between the bracket, housing and container than in the system of the '759 application wherein the bracket and housing are mounted to the container solely by two fasteners extending through holes 88, 90 formed in flange 86 which abuts a wall of the container.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
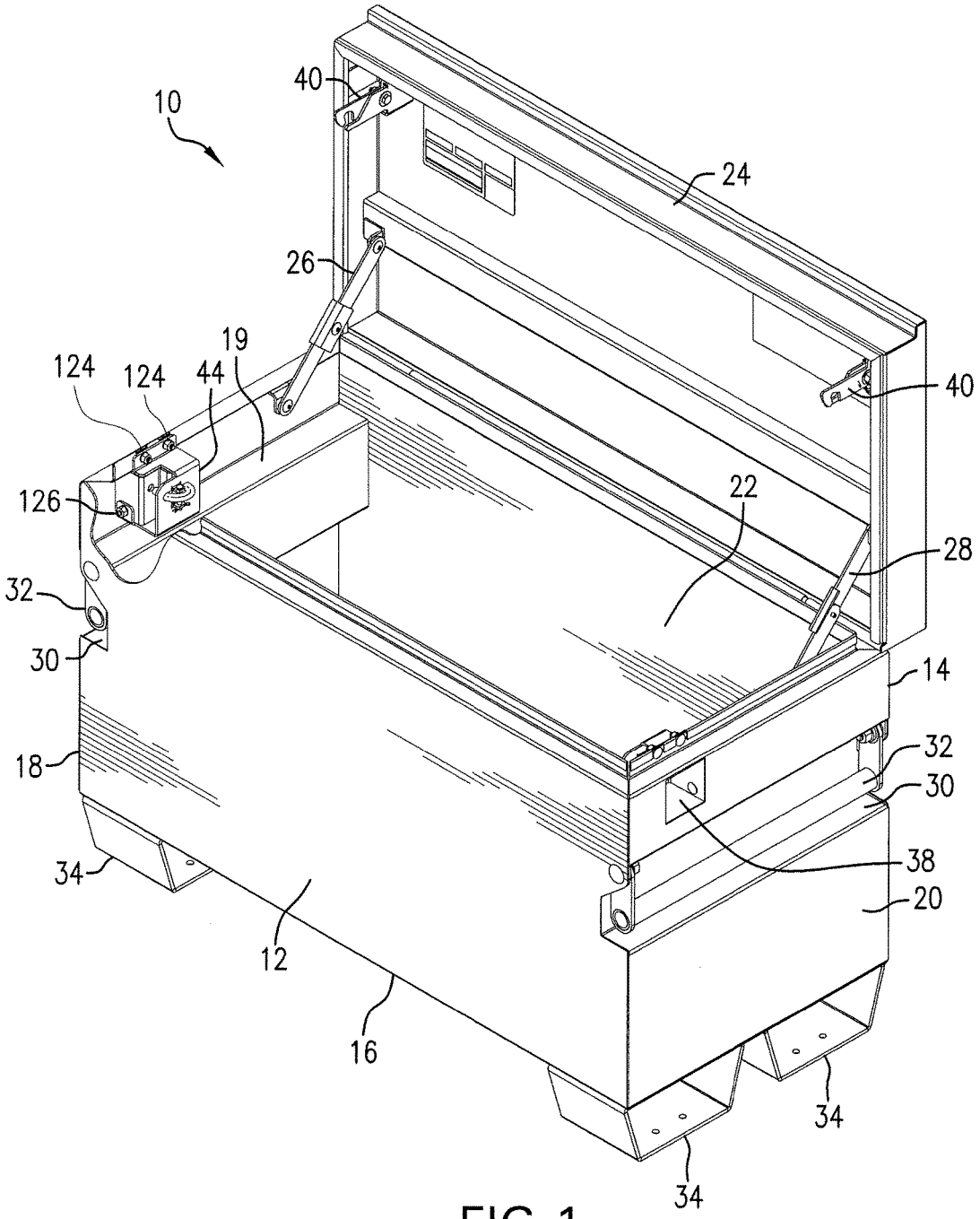
FIG. 1 is a perspective view of a storage container with the locking system of this invention.

Referring initially to FIG. 1, a storage container 10 is illustrated which comprises a front wall 12, a back wall 14, a bottom wall 16 and opposed end walls 18, 20 interconnected to front a hollow interior 22. A lid 24 is mounted by a hinge (not shown) to the back wall 14 and movable between a closed position covering the hollow interior 22, and an open position where it is held in place by support legs 26, 28 connected between the lid 24 and respective end walls 18, 20. Each end wall 18, 20 may be formed with an elongated channel 30 extending between the front and back walls 12, 14 within which a handle 32 is mounted. Preferably, a foot plate 34 is mounted at each corner of the bottom wall 16. For purposes of the present discussion, the terms "top," "bottom," "vertical," "horizontal," "inwardly" and "outwardly" refer to the orientation of the container 10 as shown in the Figs.

The container 10 is locked in the closed position by two locking assemblies 36, each located at a cavity 38 formed in respective ends walls 18, 20, in cooperation with two hawk-bill latches 40 mounted to the lid 24. One locking assembly 36 and one latch 40 are collectively referred to herein as a locking system, and there are two locking systems identical to one another located at each end wall 18, 20 of the container 10 only one of which is described below.

Figure 2:
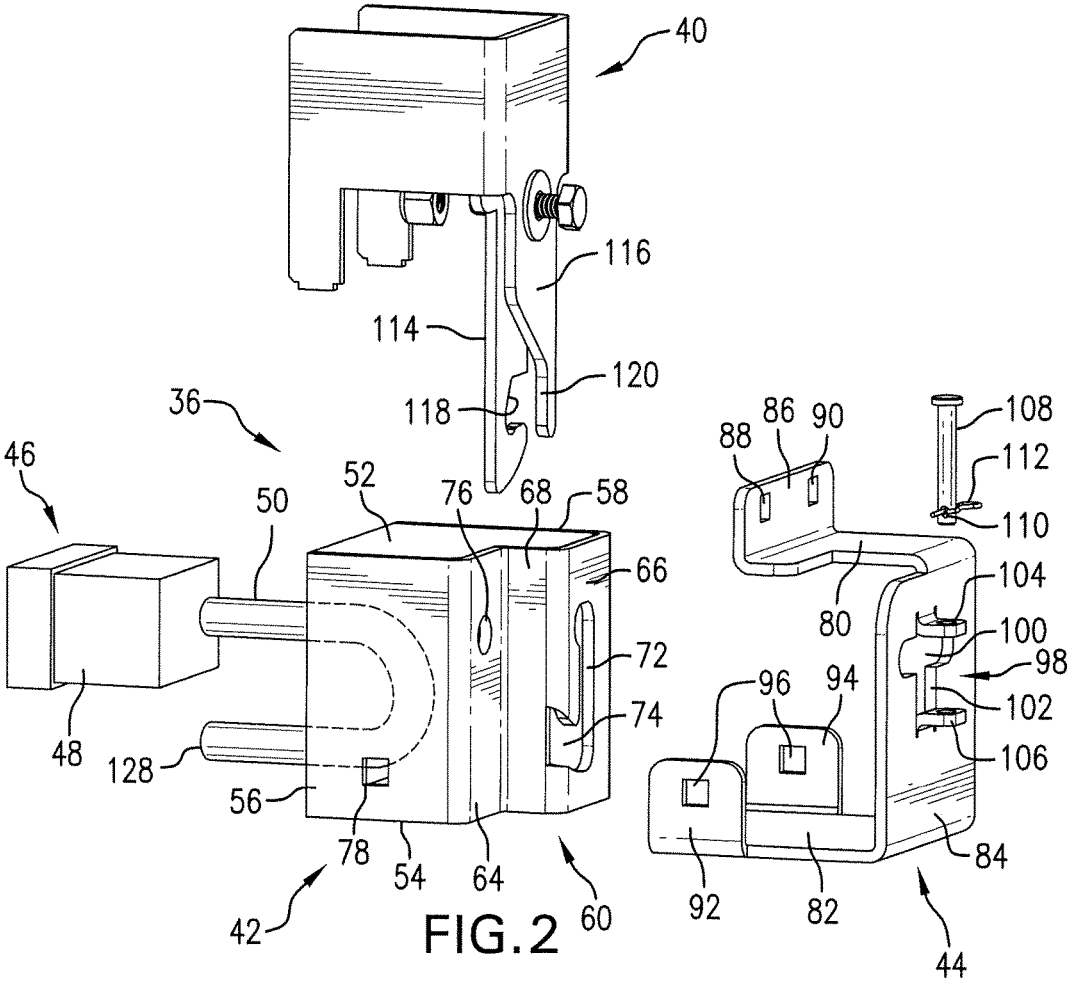
FIG. 2 is an exploded, perspective view of the locking system herein depicted the padlock, housing, bracket and latch mechanism.
Figure 3:
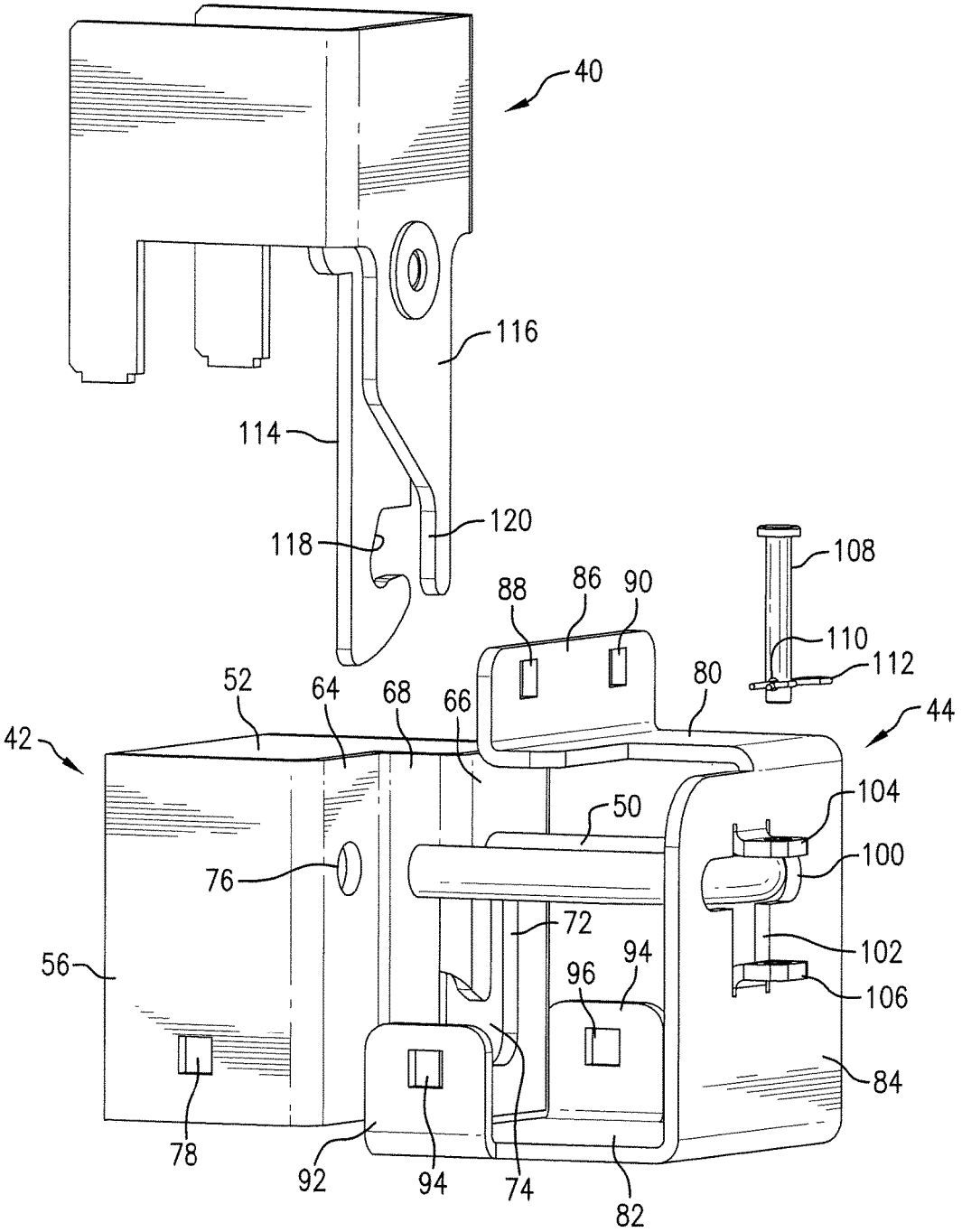
FIG. 3 is a view similar to FIG. 2 except showing the shackle of the padlock having been inserted through a slot in the housing, turned 90°, and then entering a slot in the bracket.
Figure 6:
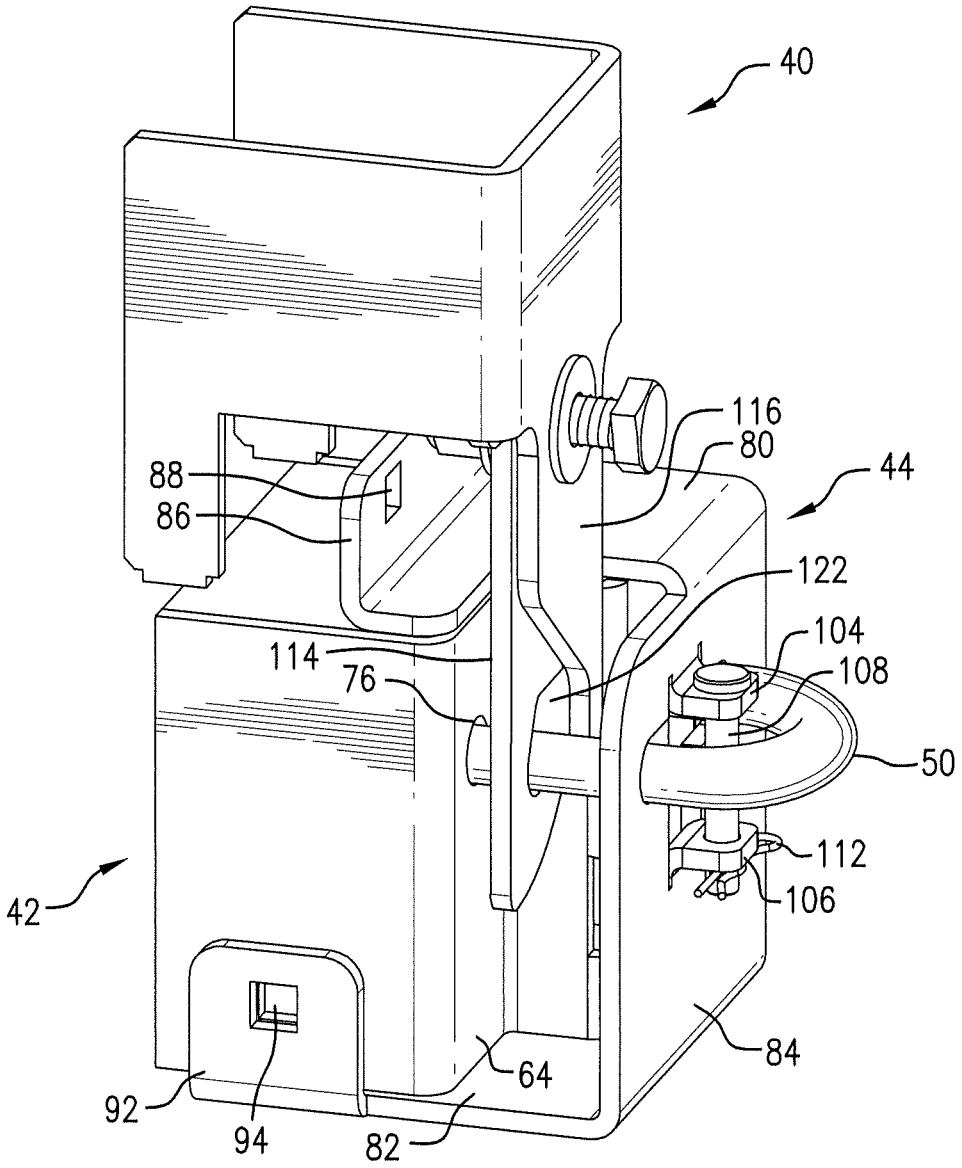
FIG. 6 is a view of the latch mechanism captured by the shackle after closing the container lid.
Figure 8:
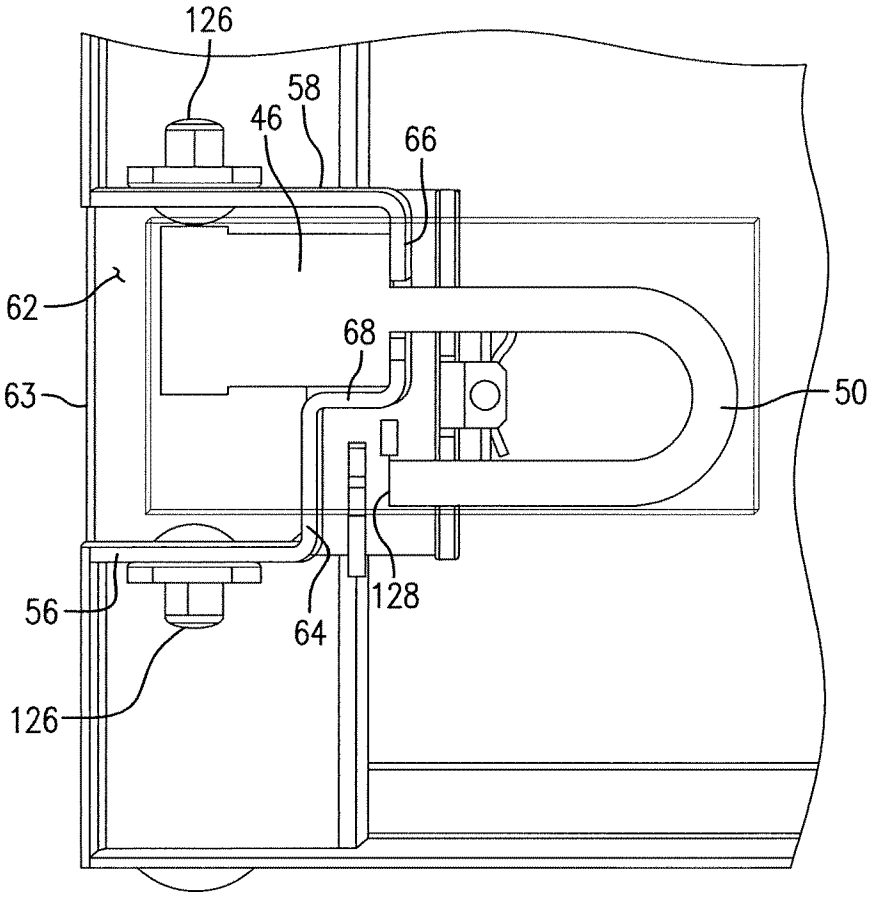
FIG. 8 is a view similar to FIG. 7 except with the shackle unlocked and the padlock body inside of the pocket.
Figure 7:
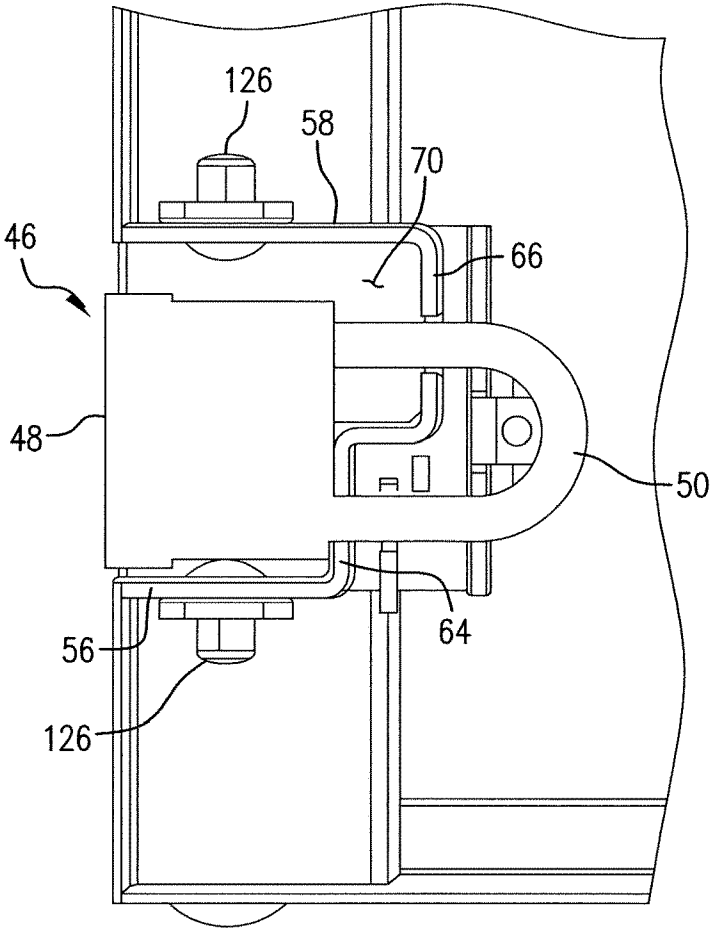
FIG. 7 is a plan view of the locking system mounted to an end wall of the container depicting the shackle in the locked position and the padlock body outside of a pocket in the housing interior.

Referring now to FIGS. 2-8, each locking assembly 36 of this invention comprises a housing 42, a bracket 44 and a padlock 46 having a padlock body 48 and shackle 50. The housing 42 comprises a top wall 52, a bottom wall 54, opposed side walls 56, 58 and a back wall 60 defining an interior 62 having an open front end 63. See FIG. 8. The back wall 60 is formed with a first section 64 joined along one edge to the side wall 56, a second section 66 joined along one edge to the side wall 58 and a middle section 68 connected between the first and second sections 64, 66. As best seen in FIGS. 2, 7 and 8, the side wall 58 is longer than side wall 56, as measured in a direction from the front end 63 of the housing 42 toward the back wall 60, which, together with the second section 66 and middle section 68, forms a pocket 70 within the housing interior 62. Preferably, the second section 66 of the back wall 60 has a vertical slot 72 joined to a generally horizontally extending notch 74. The first section 64 is formed with a hole 76, and each of the side walls 56, 58 is formed with an opening 78.

As depicted in the Figs., the bracket 44 is generally C-shaped having a top plate 80, a bottom plate 82 and a vertical plate 84 connected between the top and bottom plates 80, 82. The top plate 80 has a flange 86 formed with spaced holes 88, 90, and the bottom plate 82 mounts opposed side tabs 92, 94 each formed with a hole 96. The vertical plate 84 is formed with a generally T-shaped opening 98 which includes a horizontal head section 100 and a vertical leg section 102. A pin tab 104 is mounted to the vertical plate 84 at the top of head section 100, and a second pin tab 106 is mounted to the vertical plate 84 at the bottom of leg section 102. These pin tabs 104, 106 receive a retaining pin 108 having a hole 110 for insertion of a cotter pin 112 as described below.

The hawk-bill latches 40 are commercially available and the details of same form no part of this invention. For purposes of the present discussion, each latch 40 includes latch arms 114, 116 which are movable between and open and closed positions, but are normally biased to the closed position by a spring. The lower end of each latch arm 114, 116 is formed with a notch 118, 120, respectively, which collectively define an opening 122 when the latch arms 114, 116 are in the closed position. See FIG. 6.

The housing 42, bracket 44 and padlock 46 are assembled together, and to the container 10, as follows. Initially, and with reference to the left-hand side of FIG. 1, the bracket 44 is connected by fasteners 124 inserted through the holes 88, 90 in flange 86 to the inside of the end wall 18 covering the cavity 38 therein. The shackle 50 of the padlock 46 is uncoupled from the padlock body 48 and placed in a vertical orientation as shown in FIG. 2. The padlock 46 is moved into the interior 62 of the housing 42 so that its shackle 50 extends into the vertical slot 72 in the back wall 60 of the housing 42. Once the padlock 46 is inside of the housing 42 its shackle 50 may then be turned 90° within the horizontally extending notch 74 to assume the position shown in FIG. 3.

The housing 42 and padlock 46, with the now horizontally oriented shackle 50, are moved in an inward direction toward the interior 24 of container 10 so that the bottom wall 54 of the housing 42 slides along the bottom plate 82 of bracket 44, its top wall 52 slides along the top plate 80 of bracket 44, and, the shackle 50 enters the head section 100 of the T-shaped opening 98 in the vertical plate 84 of bracket 44. See FIG. 3. Once the second section 66 of the back wall 60 of housing 42 contacts the vertical plate 84 of bracket 44, the shackle 50 assumes the position depicted in FIG. 4 and the holes 96 formed in tabs 92, 94 of bracket 44 align with the openings 78 formed in respective side walls 56, 58 of the housing 42. Fasteners 126 are insertable through the aligning holes 96 and openings 78 to secure the housing 42 and bracket 44 together. See FIGS. 7 and 8. Additionally, with the shackle 50 in the position shown in FIG. 4, the retaining pin 108 may be inserted into the pin tabs 104, 106 carried by the vertical plate 84 of bracket 44 and then secured in place by inserting the cotter pin 112 into the hole 110 in pin 108. This prevents the padlock 46 from being pulled in an outward direction and disengaging the bracket 44.

Figure 4:
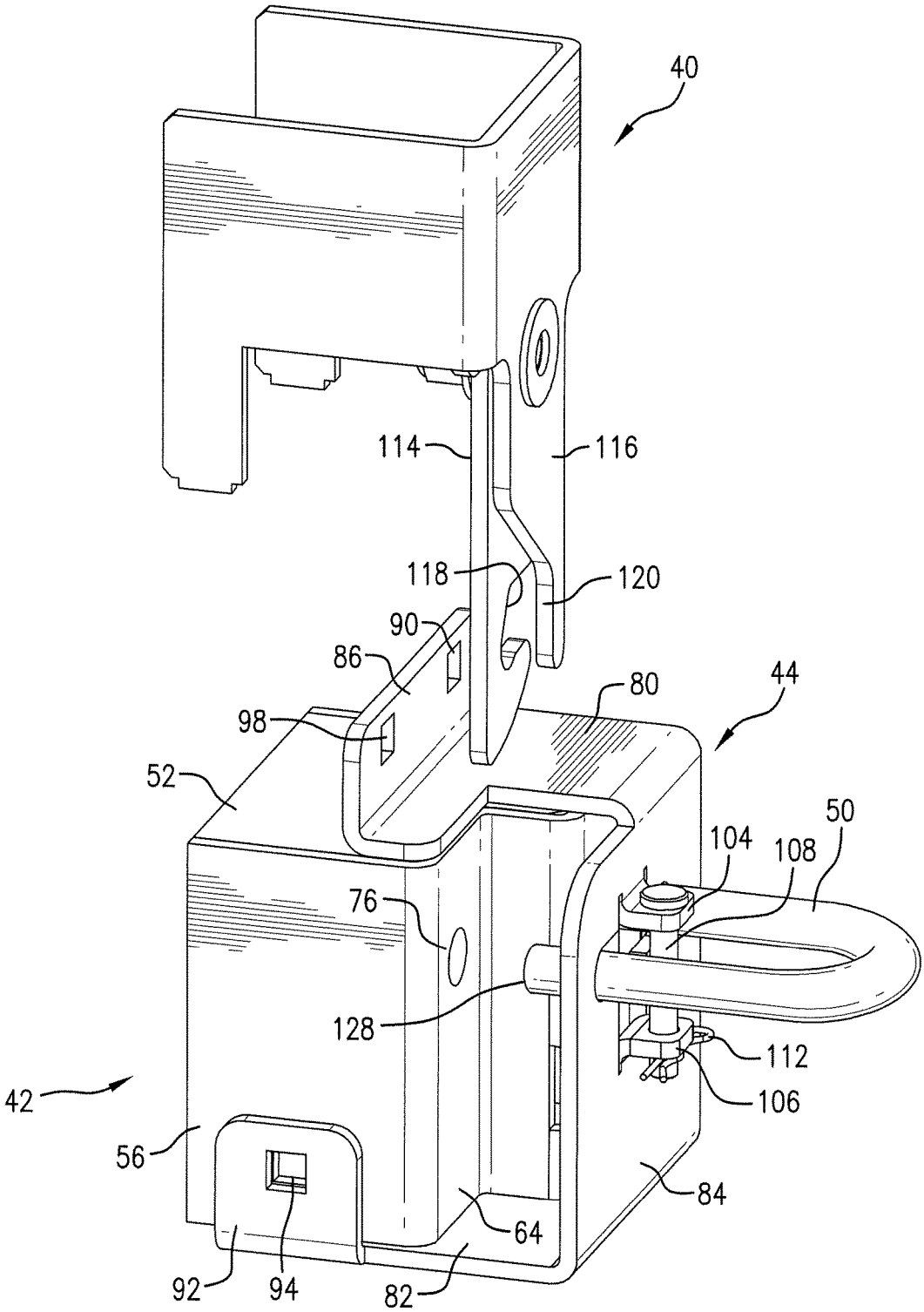
FIG. 4 is a view similar to FIG. 3 with the housing and bracket assembled and the shackle in an unlocked position.
Figure 5:
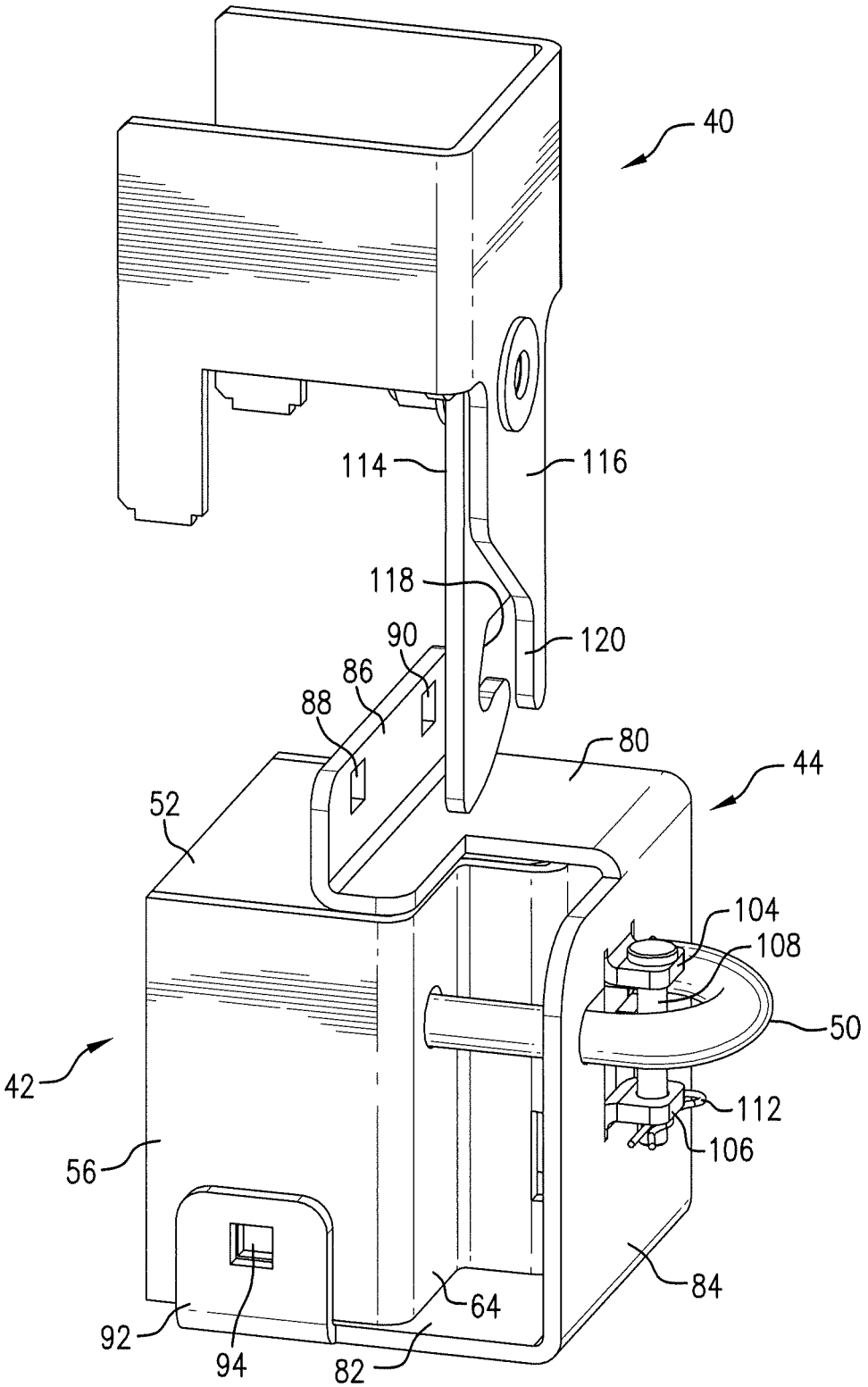
FIG. 5 is a view similar to FIG. 4 except with the shackle in a locked position.

FIGS. 4 and 7 depict the padlock 46 in an unlocked condition wherein the free end 128 of its shackle 50 is spaced from and aligns with the hole 76 in the first section 64 of the back wall 60 of housing 42. The padlock 46 is locked by inserting the free end 128 through hole 76 into the padlock body 48. See FIG. 5. As illustrated in FIG. 7, when the padlock 46 is locked its padlock body 48 is oriented substantially horizontally and located outside of the pocket 70 in the interior 62 of housing 42.

With reference to FIG. 6, with the padlock 46 in the locked position the lid 24 of the container 10 may be moved to the closed position carrying with it latch 40. As the lid 24 moves downwardly, the latch arms 114, 116 contact the shackle 50 and are spread apart against the bias of the spring that normally urges them together. Further downward movement of the lid 24 positions the latch arms 114, 116 so that their respective notches 118, 120 each extend around the shackle 50 causing it to become encircled by the opening 122 collectively formed by such notches 118, 120. In this position, the shackle 50 prevents the lid 24 from being opened.

In order to unlock the container 10, and allow lid 24 to be opened, the padlock 46 is unlocked by a key (not shown) inserted into the padlock body 48 within the cavity 38 in the end wall 18 (and end wall 20) of housing 42. Unlocking the padlock 46 causes the shackle 50 to disengage the padlock body 48 allowing it to be turned about 90° to the orientation shown in FIG. 8. When in this position, the padlock body 48 may be pushed in an inward direction, toward the container interior 24, and into the pocket 70 in the housing 42. The shackle 50 moves in the same direction with the padlock body 48 as it is pushed inwardly so that the portion of the shackle 50 which had been encircled by the latch arms 114, 116 passes through the opening 122 between them. Once the shackle 50 clears the latch arms 114, 116, as illustrated in FIG. 8, the lid 24 may be opened. The shackle 50 and padlock body 48 may remain in the position shown in FIG. 8 with the lid 24 opened or closed in order to permit use of the container 10 without having to unlock it. In order to lock the container 10, one may push the shackle 50 in an outward direction, away from the container interior 24, by reaching inside of the container 10 and grasping the shackle 50. After the padlock body 48 is outside of pocket 70, it may be rotated back to the position shown in FIG. 7 and the free end 128 of shackle 50 may be inserted through the hole 76 in back wall 60 of housing 42 into the padlock body 48. See FIGS. 5 and 7. The padlock 46 is then ready to receive the latch 40 as discussed above.

Referring now to FIGS. 9-14 an alternative embodiment of a locking system 140 according to this invention is illustrated. The locking system 140 includes the same padlock 46 and housing 42 described above in connection with a discussion of Figs, 1-8, except housing 42 is modified to include a flange 43. The locking system 140 cooperates with a latch 40 as depicted in FIGS. 1-8, and described below. Elements of locking system 140 which are common to those shown in FIGS. 1-8 and described above are given the same reference numbers in FIGS. 9-11.

The bracket 142 employed in locking system 140 is somewhat different from bracket 44 in FIGS. 1-8. Bracket 142 comprises a top plate 144, a bottom plate 146 and a vertical plate 148 connected between the top and bottom plates 144, 146. The top plate 144 has a top flange 150 formed with spaced holes 152, 154, and the bottom plate 146 mounts opposed bottom flanges 156 each formed with a hole 160. Only one of the bottom flanges 156 is shown in the Figs. for ease of illustration. The vertical plate 148 is formed with a generally horizontally extending slot 162 which is intersected by two vertically oriented locking slots 164 and 166 which are spaced from one another along the slot 162.

Figure 9:
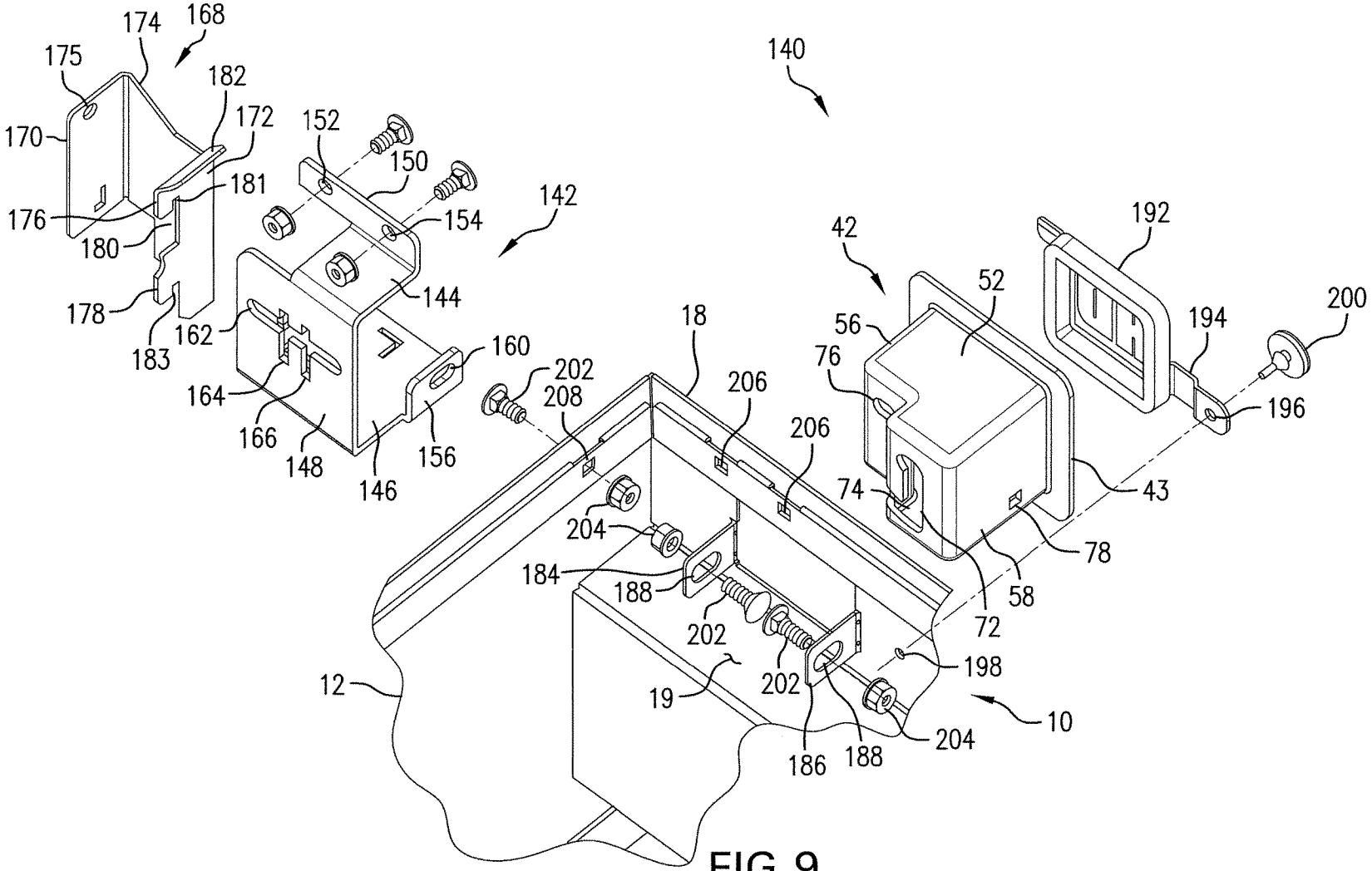
FIG. 9 is an exploded, perspective view of an alternative embodiment of the locking system of this invention including a guard.
Figure 10:
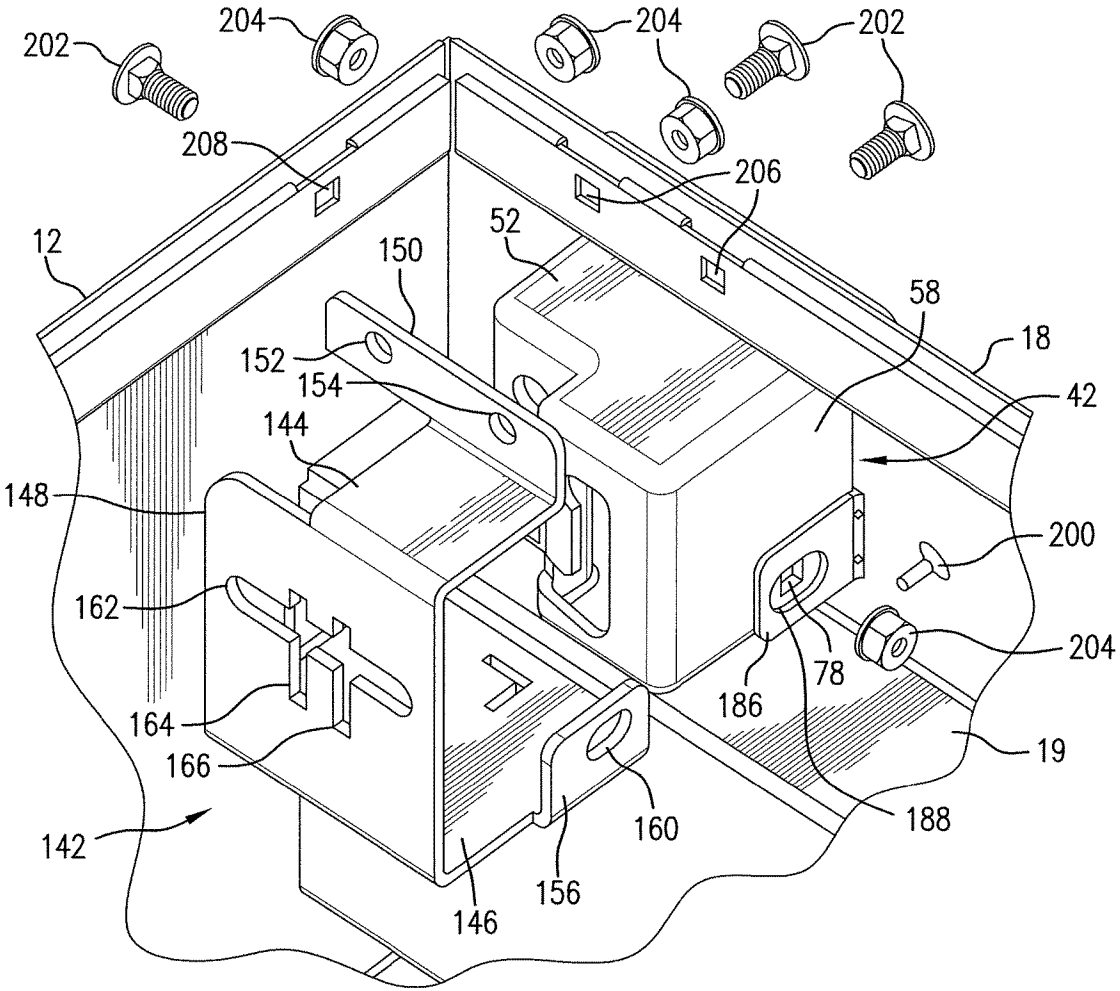
FIG. 10 is a perspective view of the embodiment of FIG. 9 in which the housing is mounted to an end wall of the container and the bracket is depicted in a position prior to connection to the housing.
Figure 11:
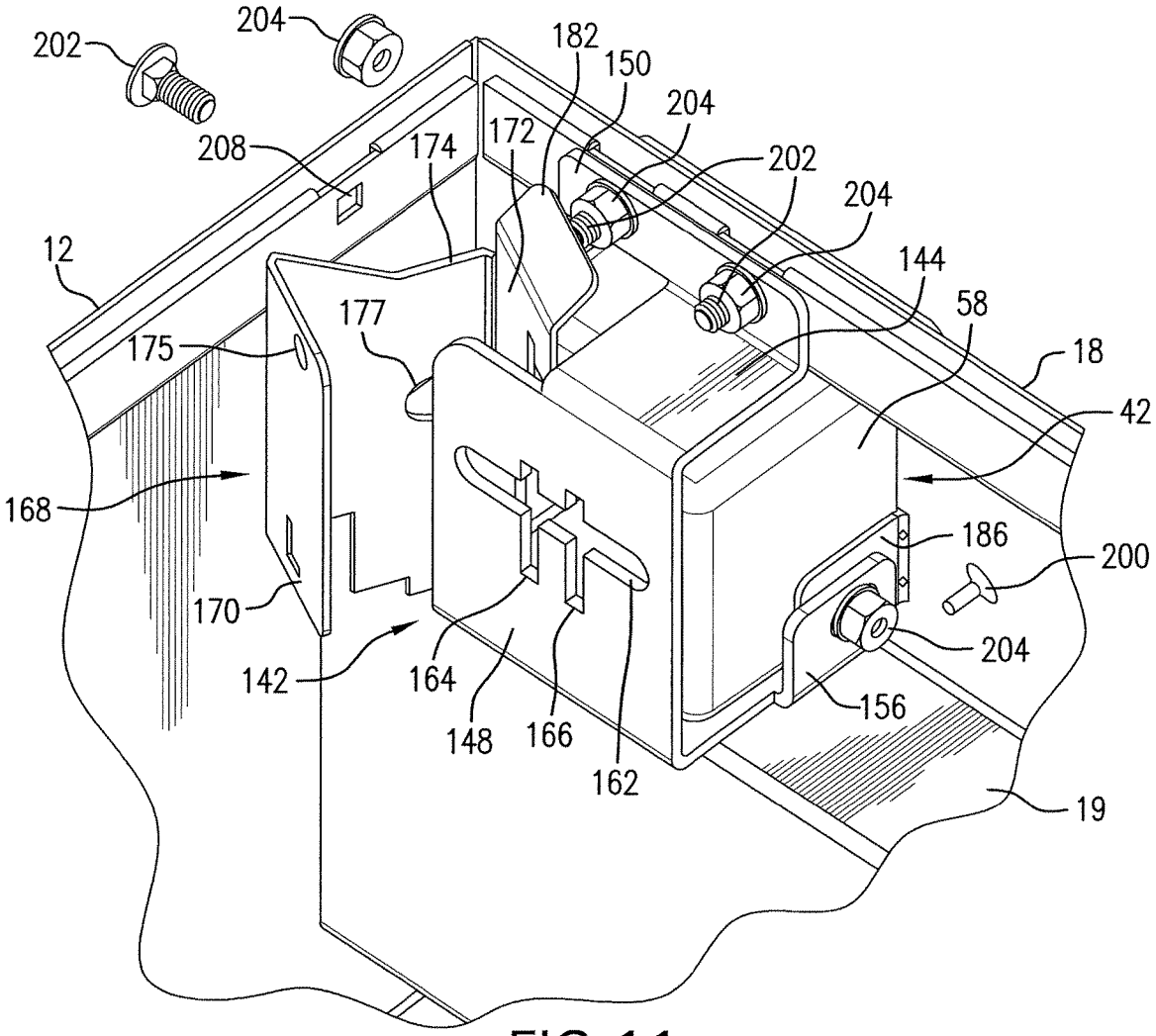
FIG. 11 is a perspective view similar to FIG. 10 except with the bracket and housing connected to one another and the guard positioned to be assembled with the bracket.
Figure 12:
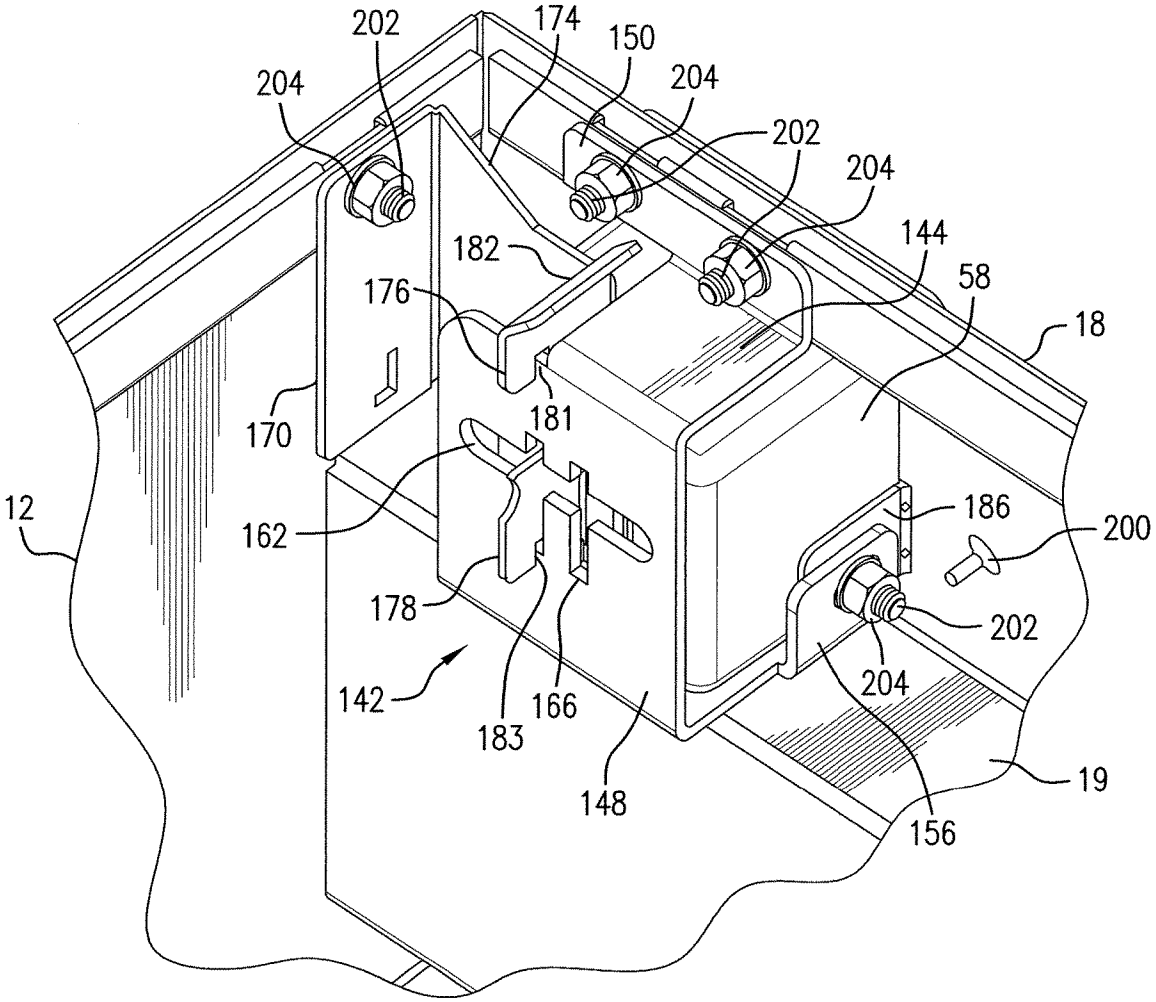
FIG. 12 is a perspective view of the fully assembled locking system of the embodiment shown in FIGS. 9-11.
Figure 13:
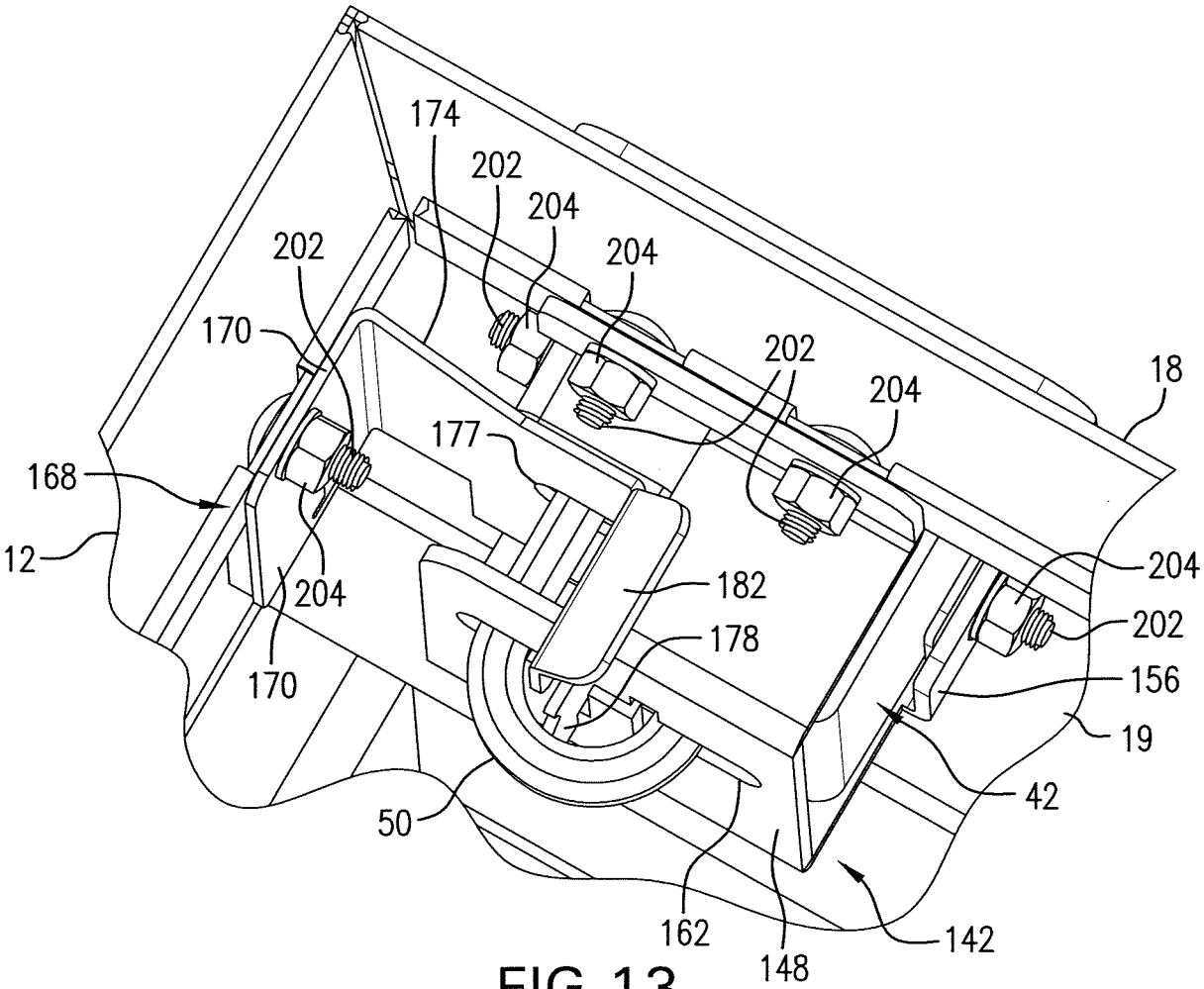
FIG. 13 is a top perspective view of the locking assembly shown in FIG. 12 with the shackle of the padlock illustrated in a locked position.
Figure 14:
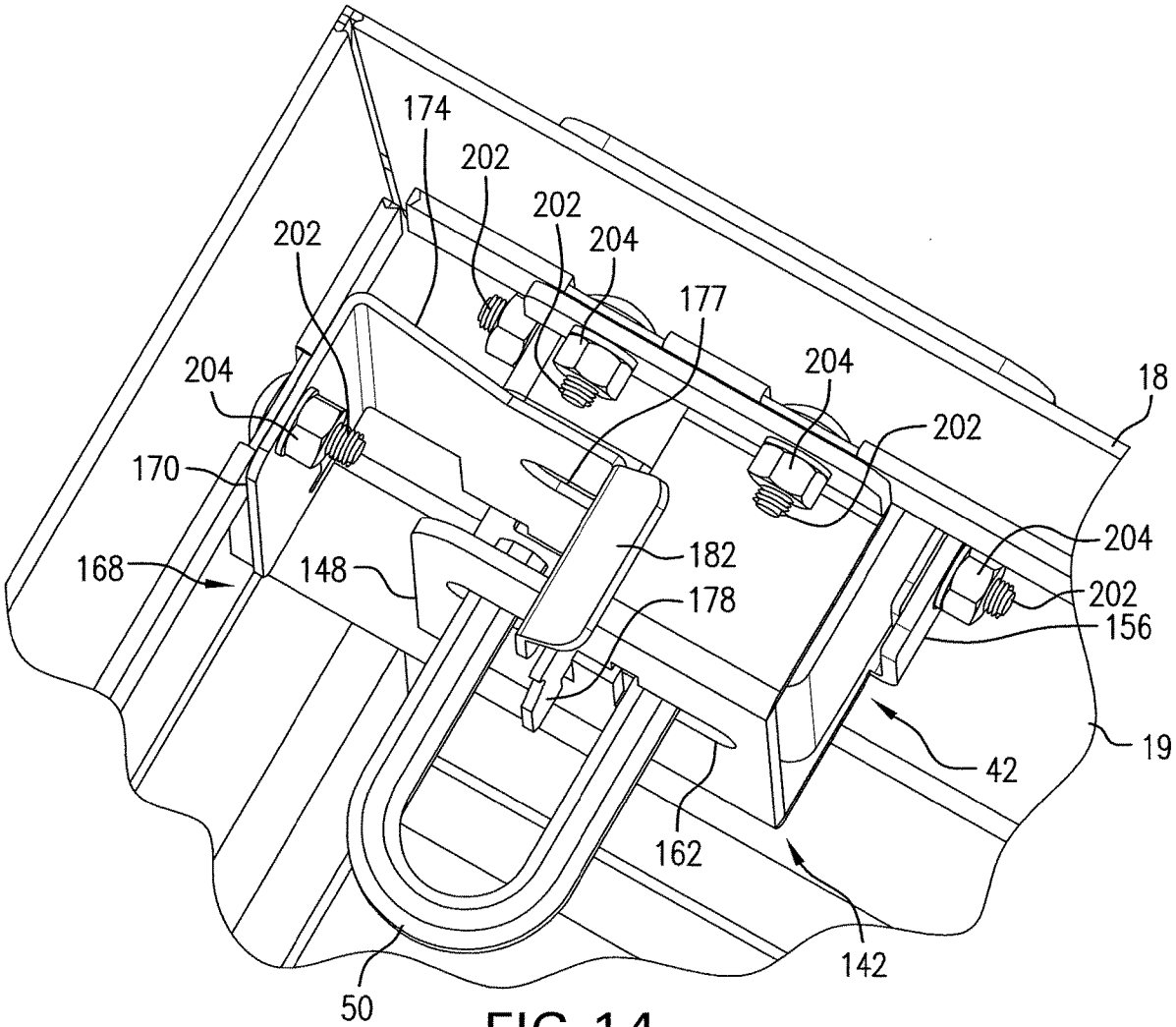
FIG. 14 is a view similar to FIG. 13 except with the shackle in an unlocked position.

The locking system 140 further comprises a guide 168 which comprises a first end wall 170, a second end wall 172 and a side wall 174 connected between the first and second end walls 170, 172. As best seen in FIG. 9, the second end wall 172 has an upper tab 176 and a lower tab 178 which are spaced from one another to form recess 180 between them. An upper end of the recess 180 defines a notch 181 in between the upper tab 176 and the second end wall 172, and a second notch 183 is formed between the lower tab 178 and second end wall 172. Additionally, the second end wall 172 is formed with an angled cover plate 182 extending outwardly therefrom. The front wall 170 is formed with a bore 175. As best seen in FIGS. 11, 13 and 14, the side wall 174 is formed with an opening 177 to receive shackle 50, as described below.

One feature of the locking system 140 shown in FIGS. 9-14 is the provision of more robust structure to secure the housing 42 and bracket 142 to the end wall 18 of container 10. Referring again to FIG. 9, a pair of spaced mounting arms 184 and 186 each formed with an opening 188 are fixed to the end wall 18 on either side of a cut-out 190 formed therein. The cut-out 190 may be covered by a face plate 192 when the locking system 140 is mounted to end wall 18. Preferably, the face plate 192 has a side plate 194 formed with a hole 196 which aligns with a hole 198 formed in end wall 18 when the face plate 192 is positioned over cut-out 190. The face plate 192 may be secured to the end wall 18 by a rivet 200 inserted through the aligning holes 196, 198 and connected to end wall 18.

In order to assemble the locking system 140, the housing 42 is initially placed against the end wall 18 over the cut-out 190 so that the mounting arm 186 contacts the side wall 58 of the housing 42. See FIG. 10. Although not shown in the Figs., the mounting arm 184 contacts side wall 56 of housing 42. In this position, the opening 78 in each of the side walls 56, 58 aligns with the opening 188 in respective mounting arms 184, 186. As shown in FIG. 11, the bracket 142 may then be slid into engagement with housing 42 such that the top plate 144 of bracket 142 contacts the top wall 52 of housing 42, and the bottom plate 146 of bracket 142 slides underneath the bottom wall 54 of housing 42 and rests atop a shelf 19 affixed to the end wall 18. With the bracket 142 in an assembled position, its bottom flanges 156, 158 straddle respective first and second mounting arms 184, 186. The hole 160 in each bottom flange 156, 158 aligns with an opening 188 in respective first and second mounting arms 184, 186 and an opening 78 in respective side walls 56, 58 of housing 42. A fastener such as a bolt 202 may be inserted through the aligning openings 160, 188 and 78, with a nut 204 tightened down along each protruding end, to secure the bracket 142 and housing 42 to the end wall 18 of the container 10. Additionally, bolts 202 may be inserted through holes 206 in the end wall 18 and into the bores 152, 154 of top flange 150, each receiving a nut 204 at a protruding end, to further secure the bracket 142 and housing 42 to the container 10.

With reference to FIG. 11, the guide 168 is illustrated in the process of being assembled to the bracket 142. For ease of illustration, the shackle 50 of padlock 46 is not shown, but shackle 50 would be positioned in its unlocked or extended position within the slot 162 prior to assembly of the guide 168. Initially, the guide 168 is located alongside the bracket 142 and then rotated such that its second end wall 172 contacts the side edge of the top plate 144 of bracket 142 and the first end wall 170 engages the front wall 12 of container 10. In the course of movement to this position, the upper edge of the vertical plate 148 of bracket 142 is captured within the notch 181 of guide 168 and its lower tab 178 extends through the locking slot 184 in bracket 142 so that the part of the vertical plate 148 at the base of locking slot 184 is captured within the second notch 183 of guide 168. As viewed FIG. 12, when the guide 168 and bracket 142 are connected to one another, both of the upper and lower tabs 176, 178 rest against the outside of vertical plate 148 and the angled cover plate 182 blocks access to the interior of the bracket 142 and housing 42 from either the front wall 12 or end wall 18 of container 10. The guide 168 is secured in this position by inserting a bolt 202 through a bore 208 formed in the front wall 12 of container 10 and through the bore 175 in the first end wall 170 of guide 168. A nut 204 is tightened down along the protruding end of bolt 202.

Referring now to FIGS. 13 and 14, the shackle 50 of padlock 46 is movable between a locked and unlocked position in the same manner as described above in connection with a discussion of FIGS. 3, 4, 7 and 8. In the locked position illustrated in FIG. 13, the latch arms 114, 116 of latch 40 may encircle a portion of the shackle 50 to lock the lid 24 of container 10 in a closed position in the same manner shown in FIG. 6 and described above. As noted above, the guide 168 is connected to the bracket 142 with the shackle 50 in the extended, unlocked position such that the free end of the shackle 50 is spaced from the side wall 174 of guide 168. See FIG. 14. In the course of moving the shackle 50 to a locked position, in order to receive the latch arms 114, 116, the shackle 50 passes through the opening 177 in the side wall 174 of guide 168 and then into the padlock body 48. The upper and lower tabs 176, 178, together with the side wall 174, collectively prevent the padlock 46 from being disengaged from the locking assembly 140. When the shackle 50 is moved to the unlocked position shown in FIG. 14, so that it is removed from opening 177 and spaced from the side wall 174 of guide 168, the latch arms 114, 116 are no longer captured by the shackle 50 thus allowing the lid 24 to be opened.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A container, comprising:

a container body having a front wall, a back wall, a bottom wall and opposed end walls interconnected to define a hollow interior, a lid connected to said container body and being movable between an open position and a closed position relative to said hollow interior;

a locking system effective to lock said lid in said closed position, said locking system comprising:

(i) a bracket mounted to said lid or to one of said front wall and opposed end walls, said bracket being formed with an opening;

(ii) a housing mounted to said bracket, said housing having an interior and being formed with an opening;

(iii) a padlock including a padlock body and a shackle having a free end, said shackle movable between a locked position in which said free end is inserted within said padlock body and an unlocked position in Which said free end disengages said padlock body, said shackle being insertable through said opening in said housing and through said opening in said bracket so that said padlock body is located within said interior of said housing;

(iv) a guard connected to said bracket in position to block access to at least a portion of said shackle when in said locked position;

a latch mechanism mounted to the other of said lid or to said front wall or opposed end walls, at least a portion of said shackle of said padlock being effective when in said locked position to capture said latch mechanism upon movement of said lid to said closed position, said latch mechanism being released by said shackle allowing said lid to move to said open position after movement of said shackle to said unlocked position.

2. The container of claim 1 in which said guard comprises a first end wall, a second end wall and a side wall extending between said first and second end walls, said second end wall being formed with an upper tab and a lower tab defining a recess between them.

3. The container of claim 2 in which said opening in said bracket comprises a first slot which receives said shackle and at least one second slot which intersects said first slot, said lower tab of said guard being insertable within said at least one second slot to mount said guard to said bracket.

4. The container of claim 3 in which said guard is formed with a first locking portion between said lower tab and said second end wall, said at least one second slot being formed in a first plate of said bracket, said first locking portion of said guide engaging said first plate of said bracket when said lower tab is inserted within said at least one second slot.

5. The container of claim 4 in which said guide is formed with a second locking portion between said upper tab and said second end wall, said second locking portion of said guide engaging said first plate of said bracket when said lower tab is inserted within said at least one second slot.

6. The container of claim 3 in which said shackle is insertable through said first slot, said shackle being located within said recess between said upper and lower tabs when in said locked position to prevent disengagement of said padlock from said locking system.

7. The container of claim 3 in which said side wall of said guard is formed with an opening, said shackle being located within said opening when in said locked position to prevent disengagement of said padlock from said locking system.

8. The container of claim 2 in which said second end wall of said guard is formed with a top plate, said top plate being positioned when said guard is mounted to said bracket to assist in blocking access to said shackle in said locked position thereof.

9. The container of claim 8 in which said top plate of said second end wall and said side wall of said guard substantially block access to said portion of said shackle which captures said latch mechanism upon movement of said lid to said closed position.

10. The container of claim 2 in which said bracket is mounted to one of said end walls of said container body, said first end wall of said guard being mounted to said front wall of said container body.

11. The container of claim 1 further including a first mounting arm and a second mounting arm, said first and second mounting arms being connected to whichever one of said lid, said front wall or said opposed end walls that said bracket is mounted to, said bracket and said housing being connected to each of said first and second mounting arms.

* * * * *